US007717049B2

(12) United States Patent
Hillenbrand et al.

(10) Patent No.: US 7,717,049 B2
(45) Date of Patent: May 18, 2010

(54) GRIPPER FOR A TUFTING MACHINE

(75) Inventors: Bernd Hillenbrand, Albstadt (DE); Timo Kaas, Balingen (DE); Klaus Kirchmair, Nusplingen (DE); Andrea Maute, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 149 days.

(21) Appl. No.: 12/010,961

(22) Filed: Jan. 31, 2008

(65) Prior Publication Data

US 2008/0264314 A1 Oct. 30, 2008

(30) Foreign Application Priority Data

Feb. 1, 2007 (EP) ..... 07002185

(51) Int. Cl.
*D05C 15/24* (2006.01)
*D05C 15/04* (2006.01)

(52) U.S. Cl. ..... 112/80.55

(58) Field of Classification Search ..... 112/80.5–80.6; 83/284, 689.91, 910, 929
See application file for complete search history.

(56) References Cited

U.S. PATENT DOCUMENTS

| | | | | | |
|---|---|---|---|---|---|
| 1,909,530 | A | | 5/1933 | Milton | |
| 2,090,021 | A | * | 8/1937 | Baynton et al. | 112/80.59 |
| 2,492,711 | A | | 12/1949 | Pickworth | |
| 2,800,096 | A | | 7/1957 | Signoret et al. | |
| 3,152,563 | A | * | 10/1964 | Broadrick | 112/80.55 |
| 4,155,318 | A | | 5/1979 | Yamamoto | |
| 4,353,317 | A | * | 10/1982 | Crumbliss | 112/80.51 |
| 5,738,027 | A | * | 4/1998 | White | 112/80.55 |

FOREIGN PATENT DOCUMENTS

| | | |
|---|---|---|
| DE | 3709977 | 10/1988 |
| DE | 4315802 | 11/1994 |
| FR | 767333 | 7/1934 |
| FR | 1473511 | 3/1967 |
| FR | 2393096 | 12/1978 |
| GB | 782079 | 8/1957 |

* cited by examiner

*Primary Examiner*—Ismael Izaguirre
(74) *Attorney, Agent, or Firm*—Fitch, Even, Tabin & Flannery; Norman N. Kunitz

(57) ABSTRACT

A gripper (3) for a tufting machine comprises a gripper body (9) having a cutout (22) for a cutting insert (10), said cutting insert preferably consisting of a hard metal. Connecting means acting in a form-closed manner are provided for the connection of the cutting insert (10) with the gripper body (9). In their simplest embodiment, said connecting means are formed by the deformation regions (37, 38) that are provided on the gripper body (9) and that reach around matching cut-outs (33, 34) of the cutting insert (10).

8 Claims, 3 Drawing Sheets

GRIPPER FOR A TUFTING MACHINE

CROSS REFERENCE TO RELATED APPLICATION

This application claims the priority of European patent application No. 07 002 185.2 filed Feb. 1, 2007, the subject matter of which, in its entirety, is incorporated herein by reference.

BACKGROUND OF THE INVENTION

The invention relates to a gripper for a tufting machine, in particular to a gripper for the production of so-called "cut-loop pile", also referred to as cut pile.

Tufting machines are used, for example, for the production of carpets/carpeting. In most cases, said machines comprise a table, above which a needle bar is arranged. This needle bar bears a plurality of tufting needles that are disposed to punch a pile thread through the textile support material that is intermittently transported across the table, said support material being referred to as the backing. A bar provided with grippers is provided under the table. With each punch of the tufting needles, the grippers insert loops formed of the tufting threads and hold said loops in place underneath the backing. In order to produce cut pile, knives are provided, said knives being held on a knife bar. These knives are moved toward the grippers and cut the loops held on said grippers.

Usually, appropriate grippers that are provided for the production of cut pile have a cutting insert that acts as a counterpart to the knife. Such a counterpart has been disclosed, for example, by document DE 23 41 567 A1 or also by document DE 28 23 408. In so doing, the gripper, in each case, consists of a flat gripper body that has a cutout for a cutting insert. The cutting insert consists of hard metal. A solder connection is used to secure said insert to the gripper body.

The hard metal insert and the gripper body display different wear resistance properties as well as different stiffness and thermal expansion properties, which can lead to problems.

Considering this, it is the object of the invention to produce an improved gripper for tufting machines.

SUMMARY OF THE INVENTION

The above object generally is achieved according to the invention with a gripper for a tufting machine which gripper comprises a gripper body with a gripper section for picking up thread loops, and a cutting insert set into a recess of the gripper body and being secured in the cutout in a form-closed manner.

The gripper in accordance with the invention comprises a gripper body with a cutting insert that is secured in a form-closed or force-closed manner in the appropriate cutout of the gripper body. The cutting insert is held in the cutout by positive-acting fastening means, whereby, however, both elements, i.e., the cutting insert and the gripper body, are allowed to behave consistent with their respective inherent elasticity and thermal expansion properties. The cutting insert and the gripper body are in contact with each other along a separating joint, whereby they are not connected to each other in said separating joint. Thus, micro-movements are possible. Consequently, a given elasticity of the gripper body is not reduced by the relatively stiffer cutting insert. Likewise, different coefficients of thermal expansion cannot lead to a bending of the gripper under conditions of temperature changes.

It is also advantageous that the gripper can be manufactured without a soldering process. Consequently, the gripper and/or the cutting insert are not subjected to any thermal stress. In particular, the cutting insert and the gripper body can be machined separately with the method that is suitable for their materials and can be exposed to corresponding treatment processes. In particular, they can be thermally treated individually separate from each other. The cutting insert, which is preferably made as a hard metal insert, is not damaged by the effect of heat as occurs during hard-soldering. The hard metal insert can be connected to the base body of the gripper without additional substances such as adhesives or solder, or any fluxing agent or similar chemicals. In addition, the gripper bodies and/or the hard metal inserts can be provided with coatings that are formed at low temperatures and do not tolerate high tempera rues. Furthermore, it is possible to provide the gripper body and the cutting insert with various coatings. For example, the gripper body may be provided with a coating that displays good sliding properties in order to reduce wear of the tufting needles, for example. Such coatings are Teflon coatings, for example. They also improve the sliding properties of the tufting thread. In contrast, the cutting insert may be provided with a layer to increase wear resistance. Such a coating may be, for example, a metallic hard material layer, a ceramic layer or the like.

The cutting insert preferably has cutouts on at least two opposing locations, whereby projections on the gripper body project into said cutouts. The cutouts may be limited by surfaces that are inclined relative to the flat sides. These inclined surfaces are preferably oriented at an angle of 40° to 70° relative to said flat side and define a free space into which the material of the gripper body may be stamped or pressed.

Additional details of advantageous embodiments of the invention are the subject matter of the drawings, the description or of the claims. In so doing, the description is restricted to essential aspects of the invention and other situations. The drawing is to be viewed as supplementary and discloses additional details. The drawings show exemplary embodiments of the invention.

DETAILED DESCRIPTION OF THE INVENTION

Figure 1:
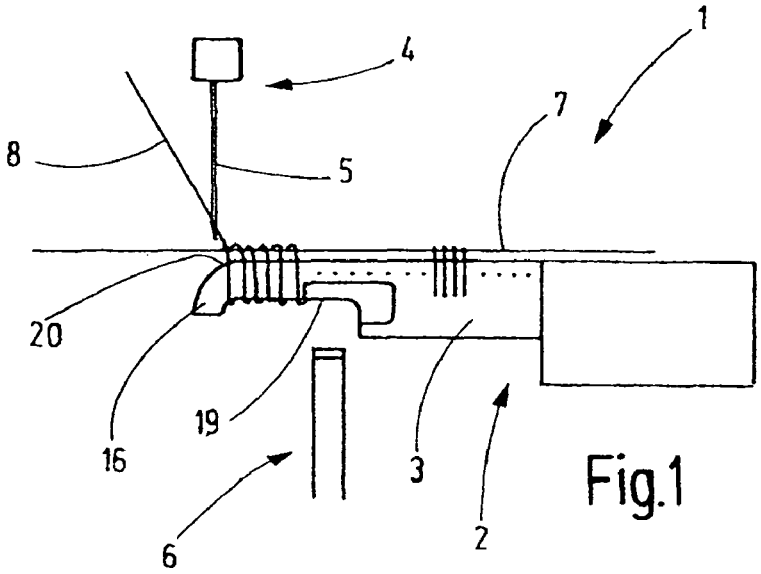
FIG. 1 is a schematic view of a tufting device with the gripper bar.

FIG. 1 shows a tufting system 1 comprising a gripper bar 2 with a plurality of grippers 3 arranged parallel next to each other, and comprising a needle bar 4 holding a plurality of tufting needles 5 parallel with respect to each other, and further comprising knives 6 that are disposed to produce cut-loop pile. A backing or support material 7 is guided over the gripper bar 2, whereby the tufting needles 5 are used to punch pile threads 8 into said backing. Among each other, the grippers 3 have the same configuration. Hereinafter, one gripper 3 is described, said gripper representing all the remaining grippers.

Figure 2:
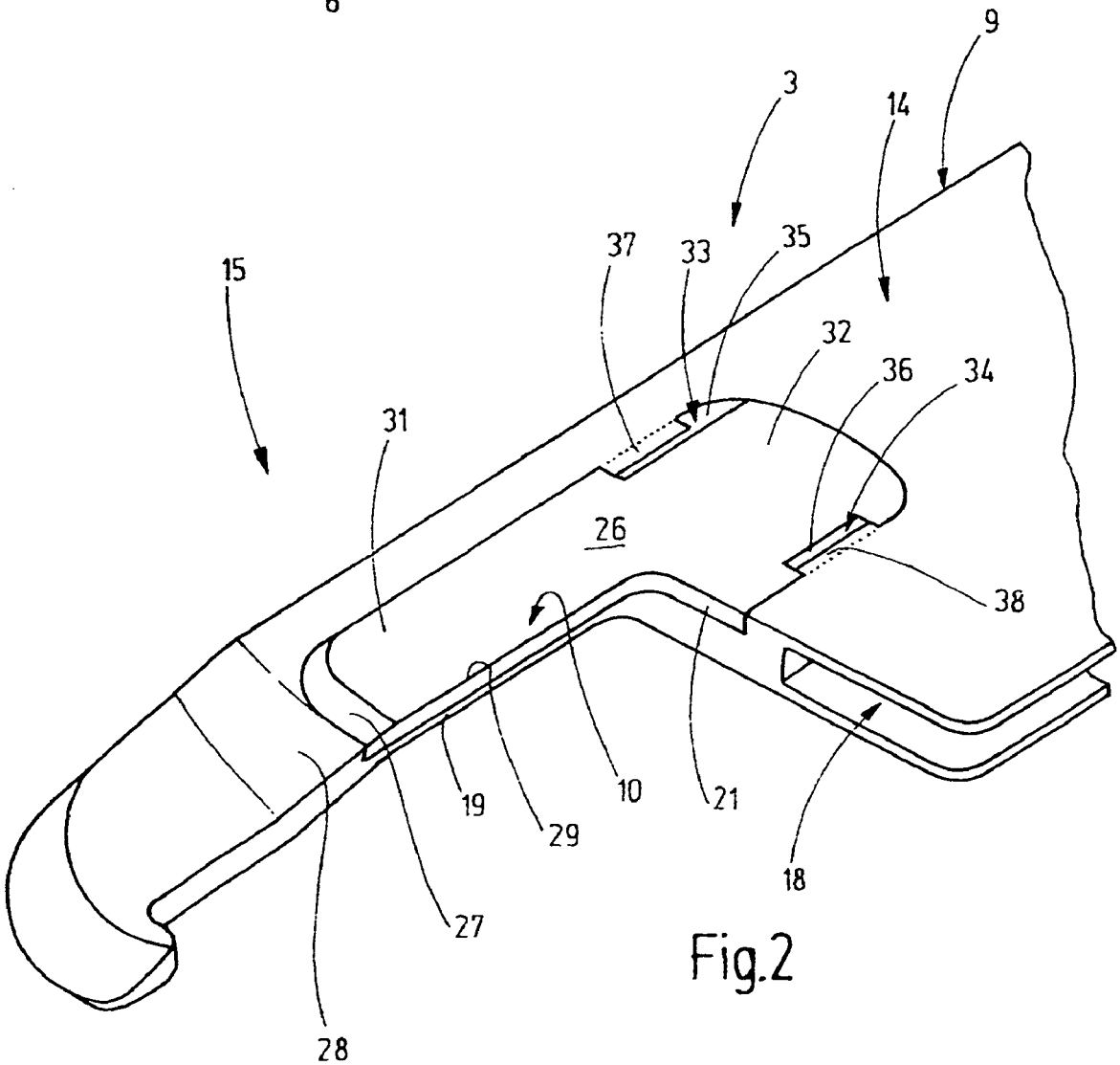
FIG. 2 is a perspective view of a detail of a gripper with the gripper bar in accordance with FIG. 1.

The gripper 3 shown separately, in detail, in FIG. 2 comprises a gripper body 9 and a cutting insert 10. Furthermore, the gripper body 9 and the cutting insert 10 are shown by FIGS. 3 through 6. As is obvious, the gripper body 9 represents a flat component with two lateral surfaces 11, 12 (FIG. 3) that are essentially flat and located parallel to each other. On its underside, the gripper has a small flat side 40 that connects the lateral surfaces 11 and 12 with each other. The gripper body 9 has a holding section 13 (FIG. 4), a center section 14 and a loop-pickup section 15. The underside 40 extends over these sections 13, 14 and 15. In so doing, the underside 40 may be slit in the region of the center section 14. Consequently, the underside 40 consists of several sections that are offset relative to each other. The holding section 13 and the loop-pickup section 15 extend away from each other from different sides of the center section in opposing directions. While the gripper body 9 has a uniform thickness in the region of the center section 14 and of the holding section 13, said gripper may be somewhat thinner along its loop-pickup section 15, as is obvious from FIG. 3. Thus, said gripper tapers toward its end 16 in the loop-pickup section 15. A cutout or recess 17 may be provided on the loop-pickup section 15, for example along the lateral surface 11, in order to avoid the so-called "J-cut". A "J-cut" is understood to mean differently long sides of a cut-open loop. In order to produce a pile with equally long sides of a cut-open loop, the knife—in the ideal case—would have to cut the loop exactly in the middle of the underside 40 of the gripper body. This cannot be technically implemented. The cutting site where the knife 6 contacts the cutting insert 10 and cuts open the loop is offset relative to the center of a loop. In order to keep this offset as minimal as possible, the gripper body 9 has the cutout 17. This cutout may have the shape of a surface that is arranged at an angle with respect to the lateral surfaces 11 and 12, beginning at the lateral surface 11 and ending at the underside 40. The center section 14 may be provided with a guide cutout in the form of a narrow deep longitudinal groove 18 in which a slider (not illustrated) can be supported so as to be movable in longitudinal direction. The slider is used in the production of looped goods in level-cut loop applications and, for this purpose, covers—in the front-most moved-out position—the end 16 of the gripper 3.

The loop-pickup section 15 has a straight edge 19 or narrow side, on which the loops 20 may slide, as is obvious from FIG. 1. In a short curved region, the edge 19 terminates in an edge 21, said latter edge forming the front end of the center section 14. One side of the gripper body 9 has a cutout 22 extending through the lateral surface 12 (FIG. 4), said cutout bordering the edge 19 as well as the edge 21. The cutout 22 is relatively flat. Its depth is smaller than half the thickness of the gripper body 9. A thin strip remains between the cutout 17 and the cutout 22. It consists of the material of the one-piece gripper body 9. The cutout 17 and the cutout 22 are at a distance from each other and do not communicate.

The cutout 22 preferably has an essentially uniform depth. Its contour corresponds to that of a rectangle with rounded corners, with a small rectangular piece taken off said rectangle by the edges 19, 21. Consequently, the recess or cutout 22 has a first longer narrow section 23 and a second shorter wider section 24.

Figure 7:
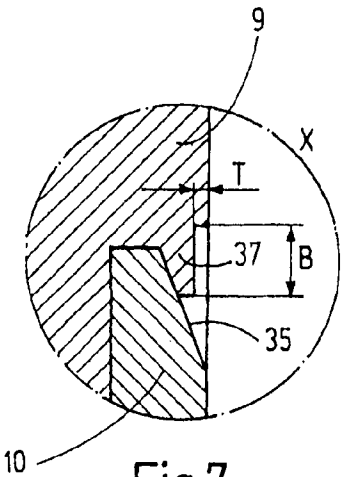
FIG. 7 is an enlarged detail of FIG. 6.
Figure 6:
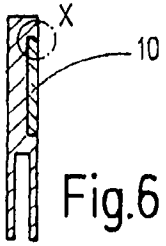
FIG. 6 is a sectional view, along line VI-VI, of the gripper in accordance with FIG. 5.
Figure 3:
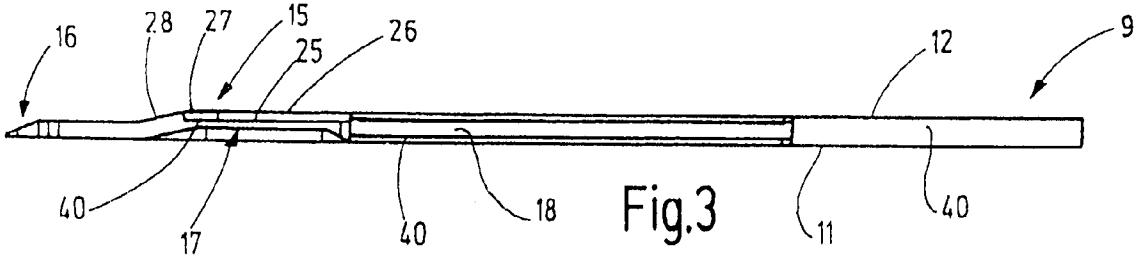
FIG. 3 is a view, from the bottom, of the gripper in accordance with FIG. 2.
Figure 4:
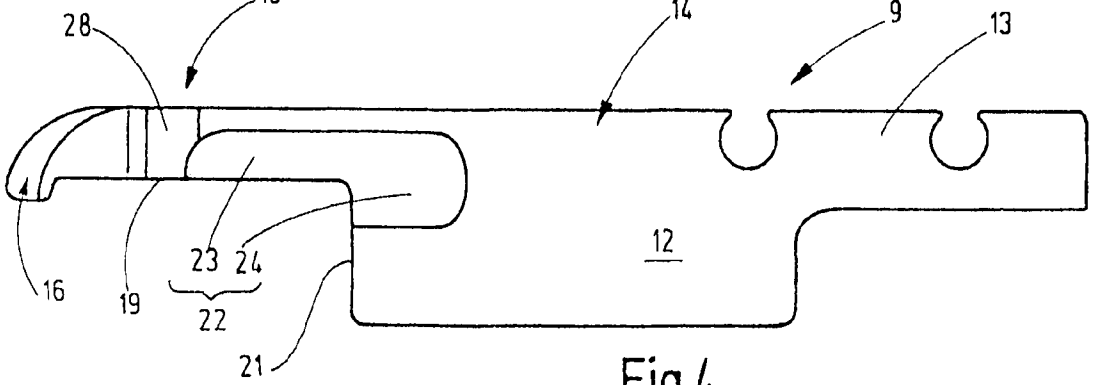
FIG. 4 is a side view of the gripper in accordance with FIG. 2, without the cutting insert.
Figure 5:
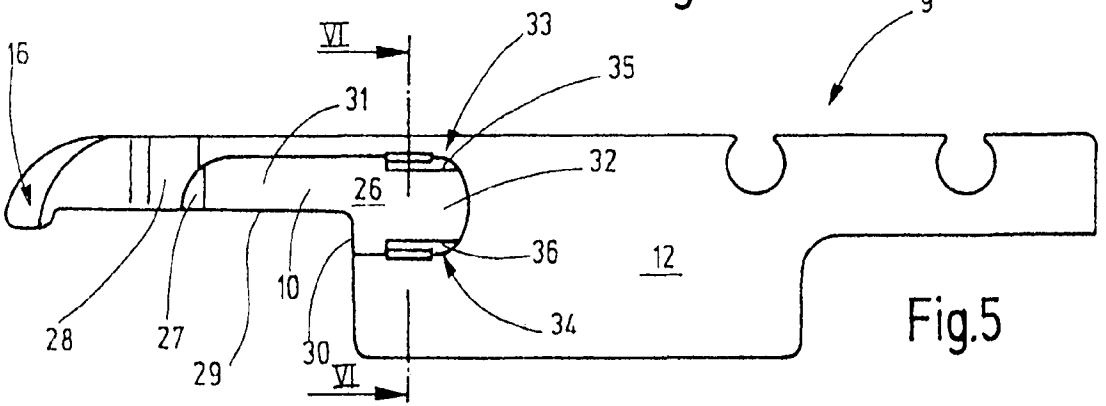
FIG. 5 is a side view of the gripper in accordance with FIG. 4, with the cutting insert.

Seated in the recess 22 is a cutting insert 10 such as is obvious from FIG. 2, as well as from FIGS. 5 through 7. This cutting insert 10 preferably consists of a different material than the gripper body 9. While the gripper body 9 may consist, for example, of a flexible steel or even of another, e.g., nonmetallic material, the cutting insert preferably is made of hard metal or of another wear-resistant material such as, for example, ceramic. Said gripper body has two flat sides 25 and 26, whereby the flat side 25 abuts against the bottom of the cutout 22. The other flat side 26 is located on the outside and is flush with the lateral surface 12 (FIG. 5). It may also project somewhat beyond the lateral surface 12. In particular, it is advantageous if the cutting insert 10 has, on its end facing in the direction of the free end of the loop-pickup section 15, a ramp-like inclined surface 27. Preferably, in a level-cut looper, this inclined surface 27 is in alignment with an inclined surface 28 of the loop-pickup section 15. As a result of the stepless transition between the two inclined surfaces 28 and 27, the pile thread forming the loop is prevented from being speared or damaged by the front edge 41 of the cutting insert 10, when said loop slides from the front end 16 of the gripper body 9 into the region of the cutting insert 10. As is shown, in particular, by FIG. 3, the inclined surface 28 forms the transition of the loop-pickup section 15 from a smaller thickness to a greater thickness.

Referring to another (not illustrated) embodiment of a cut-pile looper, the flat side 11, which does not contain the cutout 22, has the inclined surface 28.

As is obvious from FIGS. 2 and 5, the cutting insert 10 has a cutting edge 29 having a contour following the contour of the edge 19. The cutting edge 29 terminates in another edge section 30 having a contour that essentially follows that of the edge 21. Consequently, the cutting insert 10 has a first, front, section 31 that can be viewed as the cutting section and has a second, rear, section 32 that can be viewed as the holding section.

It is also possible for the cutting edge 29 of the cutting insert 10 to project beyond the edge 19 of the gripper body 9. This is indicated in FIG. 5. In so doing, the cutting edge 29 has a ramp 39 in order to form a stepless transition to the edge 19.

The contour of the cutting insert 10 corresponds to the edge of the cutout 22. Consequently, the cutting insert 10 is seated, essentially without play, in the cutout 22. In order to fasten the cutting insert, said cutting insert has cutouts 33, 34 in its holding section 32, as is shown by FIGS. 2 and 5. The cutouts 33, 34, are configured, for example by inclined surfaces 35, 36 arranged diagonally with respect to the flat side 26. The inclined surfaces 35, 36, together with the flat side 26, subtend an angle of preferably 40° to 70°. The cutouts 33, 34 are arranged on opposite sides of the holding section 32.

In order to mount the cutting insert 10, the gripper body 9 is wedged over the cutting insert 10. To achieve this, the edge regions of the cutout 22 are plastically deformed so as to reach over the inclined surfaces 35, 36. The thusly formed deformation regions 37, 38 thus hold the cutting insert in a form-closed manner in the cutout 22. This is particularly obvious from FIGS. 6 and 7 that show a greatly enlarged view thereof. Considering a depressing depth T of, for example, 0.05 mm and a resultant projection B of the deformation region 37 over the inclined surface 35, a durable and secure form-closed mounting of the overall cutting insert 10 is achieved. In so doing, it is sufficient if the length of the deformation regions 37, 38 accounts for only approximately two thirds of the length of the wider, rear, section 32 of the cutting insert 10.

The so-far described gripper 3 is disposed to operate as follows:

During operation, one end 16 of said gripper picks up loops 20 that mover over the edge 19. To do so, the gripper bar 2 is rhythmically moved, as a rule. The loops 20 move onto the cutting edge 29 of the cutting insert 10. There, they are cut open by knives 6 that are also rhythmically moved. In so doing, the knife 6 can move, e.g., over the inclined surface 27; this prevents said knife from impacting blunt on an edge of the cutting insert 10.

As mentioned, the gripper body 9 and the cutting insert 10 may consist of different materials. In addition, they may have different coatings. For example, the gripper body 9 may be provided with a friction-reducing coating of synthetic material, for example, a Teflon coating. In contrast, the cutting insert 10 may be provided with a wear-minimizing coating, for example, a metallic hard coating such as titanium nitride, titanium carbide or the like.

Figure 8:
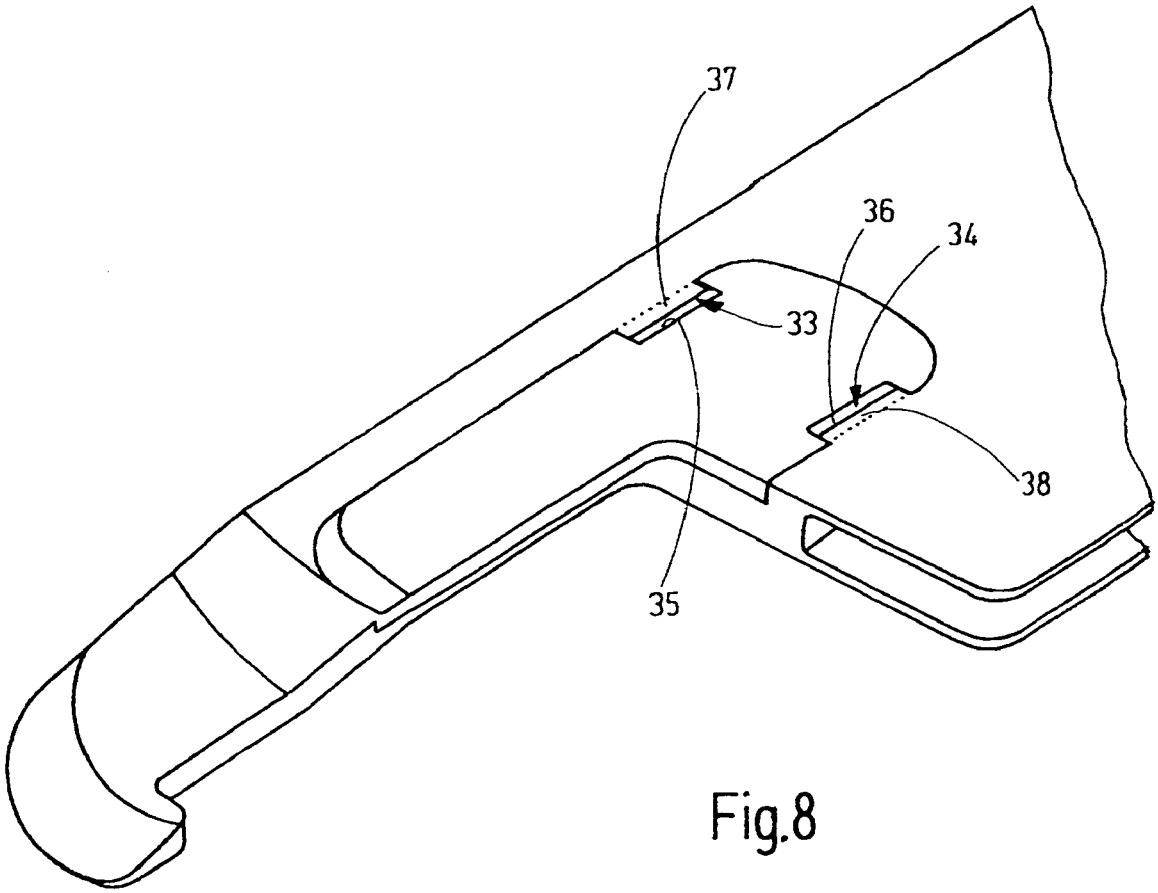
FIG. 8 is a perspective view of a modified embodiment of the gripper, similar to FIG. 2.

Referring to the above-described exemplary embodiment, the cutting insert 10 is secured in axial direction in the cutout 22 in that the cutting insert 10 is fitted exactly into the cutout 22. As is shown by FIG. 2, it is additionally possible to restrict the inclined surface 36 to a short axial region of the corresponding edge so that the deformation region 38 assumes the function of axially securing the cutting insert 10. As is shown by FIG. 8, this may also be done with regard to the two inclined surfaces 35, 36. Other than that, the above description of FIG. 8, using the same reference numbers, applies analogously.

In a possible modification of the gripper 3 in accordance with the invention, the front edge 41 of said gripper's cutting insert 10 is lowered relative to the lateral surface 42 of the loop-pickup section 15 of the gripper body 9. In addition, the lower narrow side of the cutting insert 10 is bent at a site 43 so that the cutting edge 29 forms an oblique angle 44 at that point. A section 45 of the lower narrow side of the cutting insert 10 terminates in the cutout 22 of the gripper body 9. Other than that, the above description applies analogously. The thus-described embodiment may be further modified in that the oblique angle 44 has a size on the order of 150° to 185°, preferably 165°. In the vicinity of the section 45, the otherwise straight edge 19 or its narrow side 19 of the gripper body 9 is provided with an indentation 46 that has approximately the shape of a bell. The cutting edge 29 of the cutting insert 10 projects downward beyond the edge 19. The edge 19, which is thus located above the cutting edge 29 and thus—initially starting from the edge 21—extends parallel to the cutting edge 29, terminates to the left in the indentation 46. In its continued course, the leg of the edge 19 extending from the cutting insert 10 intersects the section 45. An oblique angle is formed at the point of intersection between the indentation 46 of the edge 19 and the section 45. A thread 47 moving along the edge 19 thus does not impact the tip of the cutting insert 10 but its lower section 45.

In the vicinity of the edge 41, the edge of the cutout 17 is provided with an inclined surface 48. The inclined surface 48 forms a stepless transition from the edge 41 to the essentially flat lateral surface 42 of the loop-pickup section 15 of the gripper body 9. Thus one edge of the inclined surface 48 adjoins the edge 41 or the inclined surface 27 in a smooth and stepless manner. Its other edge adjoins the lateral surface 42. The transitions may be configured as embossed edges or may be rounded. The inclined surface 48 may be straight or arcuate, i.e., it may have a constant slope or alternating slopes.

Referring to the latter embodiment, the tip of the cutting insert 10 is located within the gripper body 9. As marked by the thread 47, the transition point for the transfer of the thread from the edge 19 to the cutting insert 10 is located at a distance from the tip or the end of the cutting insert 10. It is offset from the tip toward the edge 21. During the outward displacement of the gripper, the throat or indentation 46 improves the transfer of the thread or yarn onto the cutting insert 10. During the gripper's reverse stroke, said throat or indentation improves the transfer of the thread from the cutting insert 10 onto the gripper body 9.

The inclined surface 48 prevents the thread 47 from becoming caught on the edge 41 or on the rim of the cutout 17. In addition, the cutout 17 has a rounded wall section 49 that terminates in the edge 19. Furthermore, this chamfer or rounding 49 also prevents the thread from becoming caught or damaged.

A gripper 3 for a tufting machine comprises a gripper body 9 having a cutout 22 for a cutting insert 10, said cutting insert preferably consisting of a hard metal. Connecting means acting in a form-closed manner are provided for the connection of the cutting insert 10 with the gripper body 9. In their simplest embodiment, said connecting means are formed by the deformation regions 37, 38 that are provided on the gripper body 9 and that reach around matching cutouts 33, 34 of the cutting insert 10.

It will be appreciated that the above description of the present invention is susceptible to various modifications, changes and modifications, and the same are intended to be comprehended within the meaning and range of equivalents of the appended claims.

LIST OF REFERENCE NUMBERS

1 Tufting system
2 Gripper bar
3 Gripper
4 Needle bar
5 Tufting needle
6 Knife
7 Support material
8 Pile threads
9 Gripper body
10 Cutting insert
11 Lateral surface
12 Lateral surface
13 Holding section
14 Center section
15 Loop-pickup section/gripper section
16 End
17 Cutout
18 Guide cutout
19 Edge/narrow side
20 Loop
21 Edge
22 Cutout/recess
23 Section
24 Section
25 Flat side
26 Flat side
27 Inclined surface
28 Inclined surface
29 Cutting edge
30 Edge section
31 Section
32 Section
33 Cutout
34 Cutout
35 Inclined surface
36 Inclined surface
37 Deformation region/projections
38 Deformation region/projections
39 Ramp
40 Underside
41 Edge

42 Lateral surface
43 Site
44 Oblique angle
45 Section
46 Indentation
47 Thread
48 Inclined surface
49 Wall section

The invention claimed is:

1. Gripper for a tufting machine, said gripper comprising a gripper body with a gripper section for picking up thread loops, and a cutting insert set into a recess of the gripper body and being secured in the recess in a form-closed manner; and wherein: the cutting insert consists of a body having two flat sides; said cutting insert body is provided with cutouts on at least two opposing locations; the cutting insert is secured in the recess by projections provided on the gripper body and extending into the cutouts of the cutting insert; and the projections are formed on the gripper body by deformation of the gripper body at an edge of the recess opposite the cutouts.

2. Gripper in accordance with claim 1, wherein at least one of the cutouts is limited by a surface that is oriented inclined relative to the flat sides.

3. Gripper in accordance with claim 1, wherein the cutting insert projects beyond the gripper body.

4. Gripper in accordance with claim 1, wherein the cuffing insert is a hard metal insert.

5. Gripper in accordance with claim 1, wherein the cuffing insert is provided with a coating of hard material.

6. Gripper in accordance with claim 1, wherein the gripper body is provided with a friction-reducing coating.

7. Gripper in accordance with claim 6, wherein the friction-reducing coating is a coating of synthetic material.

8. Gripper in accordance with claim 1, wherein the cuffing insert has the shape of an oblique angle on its cutting edge.

* * * * *